US008534351B2

(12) United States Patent
Medoff

(10) Patent No.: US 8,534,351 B2
(45) Date of Patent: Sep. 17, 2013

(54) PROCESSING HYDROCARBONS

(71) Applicant: Xyleco, Inc., Woburn, MA (US)

(72) Inventor: Marshall Medoff, Brookline, MA (US)

(73) Assignee: Xyleco, Inc., Woburn, MA (US)

( * ) Notice: Subject to any disclaimer, the term of this patent is extended or adjusted under 35 U.S.C. 154(b) by 0 days.

(21) Appl. No.: 13/768,593

(22) Filed: Feb. 15, 2013

(65) Prior Publication Data

US 2013/0153465 A1 Jun. 20, 2013

Related U.S. Application Data

(63) Continuation of application No. 13/180,717, filed on Jul. 12, 2011, now Pat. No. 8,397,807, which is a continuation of application No. 12/417,786, filed on Apr. 3, 2009, now Pat. No. 8,025,098.

(60) Provisional application No. 61/073,665, filed on Jun. 18, 2008, provisional application No. 61/106,861, filed on Oct. 20, 2008, provisional application No. 61/139,324, filed on Dec. 19, 2008.

(51) Int. Cl.
*E21B 43/24* (2006.01)
*E21B 36/00* (2006.01)

(52) U.S. Cl.
USPC ..... 166/247

(58) Field of Classification Search
None
See application file for complete search history.

(56) References Cited

U.S. PATENT DOCUMENTS

| | | | | |
|---|---|---|---|---|
| 2,905,610 | A | 9/1959 | Wigner | |
| 2,955,997 | A | 10/1960 | Allen et al. | |
| 3,100,182 | A * | 8/1963 | Erdman et al. | 204/158.21 |
| 4,266,609 | A | 5/1981 | Rom et al. | |
| 4,760,882 | A * | 8/1988 | Novak | 166/295 |
| 4,772,379 | A | 9/1988 | Gomberg | |
| 7,135,155 | B1 | 11/2006 | Long, Jr. et al. | |
| 2007/0284285 | A1 | 12/2007 | Stepanik et al. | |
| 2009/0050324 | A1 | 2/2009 | McNelly et al. | |

FOREIGN PATENT DOCUMENTS

| | | |
|---|---|---|
| BE | 546729 | 10/1959 |
| GB | 866752 | 4/1961 |
| WO | 2007070698 | 6/2007 |
| WO | 2008080072 | 7/2008 |

OTHER PUBLICATIONS

Baker-Jarvis J. et al., "Mathematical model for in situ oil shale retorting by electromagnetic radiation," Fuel, IPC Science and Technology Press, GB, vol. 67, No. 7, Jul. 1, 1988, pp. 916-926, XP023632072 ISSN: 0016-2361.

ISR and Written Opinion of the ISA for International Application No. PCT/US2009/041890, mailed Jul. 16, 2009, 11 pages.

* cited by examiner

*Primary Examiner* — Zakiya W Bates
(74) *Attorney, Agent, or Firm* — Leber Patent Law, P.C.; Celia H. Leber

(57) ABSTRACT

Systems and methods that include providing, e.g., obtaining or preparing, a material that includes a hydrocarbon carried by an inorganic substrate, and exposing the material to a plurality of energetic particles, such as accelerated charged particles, such as electrons or ions.

17 Claims, 4 Drawing Sheets

PROCESSING HYDROCARBONS

RELATED APPLICATIONS

This application is a continuation of pending U.S. Ser. No. 13/180,717, filed Jul. 12, 2011, which is a continuation of U.S. Ser. No. 12/417,786 which is now U.S. Pat. No. 8,025,098, issued Sep. 27, 2011, which claimed priority from U.S. Provisional Application Ser. Nos. 61/073,665, filed Jun. 18, 2008, 61/106,861, filed Oct. 20, 2008, and 61/139,324, filed Dec. 19, 2008. The full disclosure of each of these applications is incorporated by reference herein.

TECHNICAL FIELD

This disclosure relates to processing hydrocarbon-containing materials.

BACKGROUND

Processing hydrocarbon-containing materials can permit useful products to be extracted from the materials. Natural hydrocarbon-containing materials can include a variety of other substances in addition to hydrocarbons.

SUMMARY

Systems and methods are disclosed herein for processing a wide variety of different hydrocarbon-containing materials, such as light and heavy crude oils, natural gas, bitumen, coal, and such materials intermixed with and/or adsorbed onto a solid support, such as an inorganic support. In particular, the systems and methods disclosed herein can be used to process (e.g., crack, convert, isomerize, reform, separate) hydrocarbon-containing materials that are generally thought to be less-easily processed, including oil sands, oil shale, tar sands, and other naturally-occurring and synthetic materials that include both hydrocarbon components and solid matter (e.g., solid organic and/or inorganic matter).

In some cases, the methods disclosed herein can be used to process hydrocarbon-containing materials in situ, e.g., in a wellbore, hydrocarbon-containing formation, or other mining site. In some implementations, this in situ processing can reduce the energy required to mine and/or extract the hydrocarbon-containing material, and thus improve the cost-effectiveness of obtaining products from the hydrocarbon-containing material.

The systems and methods disclosed herein use a variety of different techniques to process hydrocarbon-containing materials. For example, exposure of the materials to particle beams (e.g., beams that include ions and/or electrons and/or neutral particles) or high energy photons (e.g., x-rays or gamma rays) can be used to process the materials. Particle beam exposure can be combined with other techniques such as sonication, mechanical processing, e.g., comminution (for example size reduction), temperature reduction and/or cycling, pyrolysis, chemical processing (e.g., oxidation and/or reduction), and other techniques to further break down, isomerize, or otherwise change the molecular structure of the hydrocarbon components, to separate the components, and to extract useful materials from the components (e.g., directly from the components and/or via one or more additional steps in which the components are converted to other materials). Radiation may be applied from a device that is in a vault.

The systems and methods disclosed herein also provide for the combination of any hydrocarbon-containing materials described herein with additional materials including, for example, solid supporting materials. Solid supporting materials can increase the effectiveness of various material processing techniques. Further, the solid supporting materials can themselves act as catalysts and/or as hosts for catalyst materials such as noble metal particles, e.g., rhodium particles, platinum particles, and/or iridium particles. The catalyst materials can increase still further the rates and selectivity with which particular products are obtained from processing the hydrocarbon-containing materials.

In a first aspect, the disclosure features methods that includes exposing a material that includes a hydrocarbon carried by an inorganic substrate to a plurality of energetic particles, such as accelerated charged particles, such as electrons or ions, to deliver a level or dose of radiation of at least 0.5 megarads, e.g., at least 1, 2.5, 5, 10, 25, 50, 100, 250, or even 300 or more megarads to the material.

Embodiments can include one or more of the following features.

The inorganic substrate can include exterior surfaces, and the hydrocarbon can be carried, e.g., adsorbed, on at least some of the exterior surfaces. The inorganic substrate can include interior surfaces, and the hydrocarbon can be carried, e.g., adsorbed, on at least some of the interior surfaces. The material can include oil shale and/or oil sand.

The substrate can include a material having a thermal conductivity of less than 5 W $m^{-1}$ $K^{-1}$. The inorganic substrate can include at least one of an aluminosilicate material, a silica material, and an alumina material. The substrate can include a noble metal, such as platinum, iridium, or rhodium. The substrate can include a zeolite material. The zeolite material can have a base structure selected from the group consisting of ZSM-5, zeolite Y, zeolite Beta, Mordenite, ferrierite, and mixtures of any two or more of these base structures.

Irradiating can in some cases reduce the molecular weight of the hydrocarbon, e.g., by at least 25%, at least 50%, at least 75%, or at least 100% or more. For instance, irradiation can reduce the molecular weight from a starting molecular weight about 300 to about 2000 prior to irradiation, to a molecular weight after irradiation of about 190 to about 1750, or from about 150 to about 1000.

Embodiments can also include any of the other features or steps disclosed herein.

In another aspect, the disclosure features methods for processing a hydrocarbon material. The methods include combining the hydrocarbon material with a solid supporting material, exposing the combined hydrocarbon and solid supporting materials to a plurality of charged particles or photons to deliver a dose of radiation of at least 0.5 megarads, e.g., at least 1, 2.5, 5, 10, 25, 50, 100, 250, or even 300 or more megarads, and processing the exposed combined hydrocarbon and solid supporting materials to obtain at least one hydrocarbon product.

Embodiments can include one or more of the following features.

The solid supporting material can include at least one catalyst material. The at least one catalyst material can include at least one material selected from the group consisting of platinum, rhodium, osmium, iron, and cobalt. The solid supporting material can include a material selected from the group consisting of silicate materials, silicas, aluminosilicate materials, aluminas, oxide materials, and glasses. The solid supporting material can include at least one zeolite material.

The processing can include exposing the combined hydrocarbon and solid supporting materials to ultrasonic waves. The processing can include oxidizing and/or reducing the combined hydrocarbon and solid supporting materials.

The plurality of charged particles can include ions. The ions can be selected from the group consisting of positively charged ions and negatively charged ions. The ions can include multiply charged ions. The ions can include both positively and negatively charged ions. The ions can include at least one type of ions selected from the group consisting of hydrogen ions, noble gas ions, oxygen ions, nitrogen ions, carbon ions, halogen ions, and metal ions. The plurality of charged particles can include electrons. The plurality of charged particles can include both ions and electrons.

The processing can include exposing the combined hydrocarbon and solid supporting materials to additional charged particles. The additional charged particles can include ions, electrons, or both ions and electrons. The additional charged particles can include both positively and negatively charged ions. The additional charged particles can include multiply charged ions. The additional charged particles can include at least one type of ions selected from the group consisting of hydrogen ions, noble gas ions, oxygen ions, nitrogen ions, carbon ions, halogen ions, and metal ions.

The plurality of charged particles can include catalyst particles. The additional charged particles can include catalyst particles.

The methods can be performed in a fluidized bed system. The method can be performed in a catalytic cracking system. Exposing the combined materials to charged particles can heat the combined materials to a temperature of 400 K or more.

The methods can include exposing the combined hydrocarbon and solid supporting materials to reactive particles. Exposing the combined hydrocarbon and solid supporting materials to reactive particles can be performed during the processing. Exposing the combined hydrocarbon and solid supporting materials to reactive particles can be performed during the exposure to charged particles. The reactive particles can include one or more types of particles selected from the group consisting of oxygen, ozone, sulfur, selenium, metals, noble gases, and hydrogen. Exposing the combined hydrocarbon and solid supporting materials to reactive particles can be performed in a catalytic cracking system.

The hydrocarbon material can include oil sand. The hydrocarbon material can include oil shale.

Embodiments can also include any of the other features or steps disclosed herein.

In a further aspect, the disclosure features methods for processing a heterogeneous material that includes at least one hydrocarbon component and at least one solid component. The methods include combining the heterogeneous material with at least one catalyst material to form a precursor material, exposing the precursor material to a plurality of charged particles to deliver a dose of radiation of at least 0.5 megarads (or higher as noted herein), and processing the exposed precursor material to obtain at least one hydrocarbon product.

Embodiments of these methods can include one or more of the features discussed above.

The methods can also include combining the precursor material with a solid supporting material. The solid supporting material can include at least one zeolite material. The solid supporting material can include at least one material selected from the group consisting of silicate materials, silicas, aluminosilicate materials, aluminas, oxide materials, and glasses. The solid supporting material can include the at least one catalyst material.

In some implementations, the methods disclosed herein include providing the material by excavating a site where the material is found, and exposing the material includes delivering a source of radiation to the site where the material is found.

In a further aspect, the invention features a method that includes forming a wellbore in a hydrocarbon-containing formation; delivering a radiation source into the wellbore; irradiating at least a portion of the formation using the radiation source; and producing a hydrocarbon-containing material from the wellbore.

The method may further include thermally treating the irradiated formation, e.g., with steam, to extract the hydrocarbon-containing material therefrom.

The full disclosures of each of the following U.S. patent applications, which are being filed concurrently herewith, are hereby incorporated by reference herein: Ser. Nos. 12/417,707, 12/417,720, 12/417,699, 12/417,840, 12/417,731, 12/417,900 12/417,880, 12/417,723, and 12/417,904.

Unless otherwise defined, all technical and scientific terms used herein have the same meaning as commonly understood by one of ordinary skill in the art to which this disclosure belongs. Although methods and materials similar or equivalent to those described herein can be used in the practice or testing of the present disclosure, suitable methods and materials are described below. All publications, patent applications, patents, and other references mentioned herein are incorporated by reference in their entirety for all that they each contain. In case of conflict, the present specification, including definitions, will control. In addition, the materials, methods, and examples are illustrative only and not limiting.

The details of one or more embodiments are set forth in the accompanying drawings and description. Other features and advantages will be apparent from the description, drawings, and claims.

DETAILED DESCRIPTION

Figure 1:
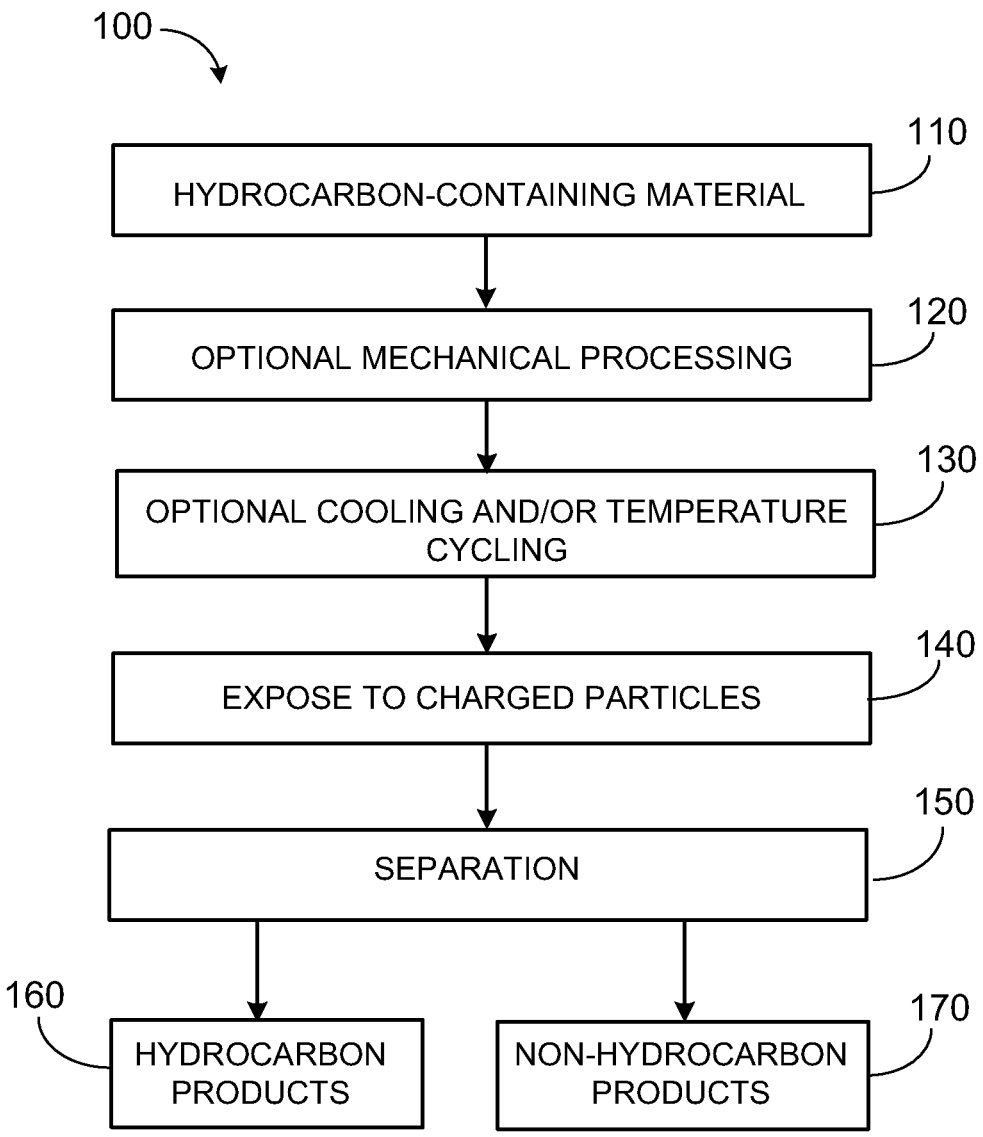
FIG. 1 is a schematic diagram showing a sequence of steps for processing hydrocarbon-containing materials.

Many embodiments of this application use Natural Force™ Chemistry. Natural Force™ Chemistry methods use the controlled application and manipulation of physical forces, such as particle beams, gravity, light, etc., to create intended structural and chemical molecular change. In preferred implementations, Natural Force™ Chemistry methods alter molecular structure without chemicals or microorganisms. By applying the processes of Nature, new useful matter can be created without harmful environmental interference.

While petroleum in the form of crude oil represents a convenient source of hydrocarbon materials in the world economy, there exist significant alternative sources of hydrocarbons—materials such as oil sands, oil shale, tar sands, bitumen, coal, and other such mixtures of hydrocarbons and non-hydrocarbon material—which also represent significant hydrocarbon reserves. Unfortunately, conventional processing technologies focus primarily on the refining of various grades of crude oil to obtain hydrocarbon products. Far fewer facilities and technologies are dedicated to the processing of alternative sources of hydrocarbons. Reasons for this are chiefly economic—the alternative sources of hydrocarbons noted herein have proved to be more difficult to refine and process, resulting in a smaller margin of profit (if any at all) per unit of hydrocarbon extracted. There are also technical difficulties associated with the extraction and refining of hydrocarbon materials from such sources. Many technical difficulties arise from the nature (e.g., the chemical and physical structure) of the hydrocarbons in the alternative materials and the low weight percentage of hydrocarbons in the hydrocarbon-containing material. For example, in certain hydrocarbon-containing materials such as tar sands, hydrocarbons are physically and/or chemically bound to solid particles that can include various types of sand, clay, rock, and solid organic matter. Such heterogeneous mixtures of components are difficult to process using conventional separation and refinement methods, most of which are not designed to effect the type of component separation which is necessary to effectively process these materials. Typically, processing methods which can achieve the required breakdown and/or separation of components in the hydrocarbon-containing materials are cost-prohibitive, and only useful when shortages of various hydrocarbons in world markets increases substantially the per-unit price of the hydrocarbons. It can also be difficult and costly to remove some hydrocarbon-containing materials, e.g., oil sands and bituminous compounds, from the formations where they are present. Surface mining requires enormous energy expenditure and is environmentally damaging, while in situ thermal recovery with steam is also energy-intensive. The use of processes described herein can, for example, reduce the temperature and/or pressure of steam required for in situ thermal recovery.

Methods and systems are disclosed herein that provide for efficient, inexpensive processing of hydrocarbon-containing materials to extract a variety of different hydrocarbon products. The methods and systems are particularly amenable to processing the alternative sources of hydrocarbons discussed above, but can also be used, more generally, to process any type of naturally-occurring or synthetic hydrocarbon-containing material. These methods and systems enable extraction of hydrocarbons from a much larger pool of hydrocarbon-containing resources than crude oil alone, and can help to alleviate worldwide shortages of hydrocarbons and/or hydrocarbon-derived or -containing products.

The methods disclosed herein typically include exposure of hydrocarbon-containing materials carried by solid substrate materials (organic or inorganic) to one or more beams of particles or high energy photons. The beams of particles can include accelerated electrons, and/or ions. Solid materials—when combined with hydrocarbons—are often viewed as nuisance components of hydrocarbon mixtures, expensive to separate and not of much use. However, the processing methods disclosed herein use the substrate materials to improve the efficiency with which hydrocarbon containing-materials are processed. Thus, the solid substrate materials represent an important processing component of hydrocarbon-containing mixtures, rather than merely another component that must be separated from the mixture to obtain purer hydrocarbons. If desired, after recovery of the hydrocarbon component, the solid substrate may be used as a separate product, e.g., as an aggregate or roadbed material. Alternatively, the solid substrate may be returned to the site.

FIG. 1 shows a schematic diagram of a technique 100 for processing hydrocarbon-containing materials such as oil sands, oil shale, tar sands, and other materials that include hydrocarbons intermixed with solid components such as rock, sand, clay, silt, and/or solid organic material. These materials may be in their native form, or may have been previously treated, for example treated in situ with radiation as described below. In a first step of the sequence shown in FIG. 1, the hydrocarbon-containing material 110 can be subjected to one or more optional mechanical processing steps 120. The mechanical processing steps can include, for example, grinding, crushing, agitation, centrifugation, rotary cutting and/or chopping, shot-blasting, and various other mechanical processes that can reduce an average size of particles of material 110, and initiate separation of the hydrocarbons from the remaining solid matter therein. In some embodiments, more than one mechanical processing step can be used. For example, multiple stages of grinding can be used to process material 110. Alternatively, or in addition, a crushing process followed by a grinding process can be used to treat material 110. Additional steps such as agitation and/or further crushing and/or grinding can also be used to further reducing the average size of particles of material 110.

In a second step 130 of the sequence shown in FIG. 1, the hydrocarbon-containing material 110 can be subjected to one or more optional cooling and/or temperature-cycling steps. In some embodiments, for example, material 110 can be cooled to a temperature at and/or below a boiling temperature of liquid nitrogen. More generally, the cooling and/or temperature-cycling in step 130 can include, for example, cooling to temperatures well below room temperature (e.g., cooling to 10° C. or less, 0° C. or less, −10° C. or less, −20° C. or less, −30° C. or less, −40° C. or less, −50° C. or less, −100° C. or less, −150° C. or less, −200° C. or less, or even less). Multiple cooling stages can be performed, with varying intervals between each cooling stage to allow the temperature of material 110 to increase. The effect of cooling and/or temperature-cycling material 110 is to disrupt the physical and/or chemical structure of the material, promoting at least partial de-association of the hydrocarbon components from the non-hydrocarbon components (e.g., solid non-hydrocarbon materials) in material 110. Suitable methods and systems for cooling and/or temperature-cycling of material 110 are disclosed, for example, in U.S. Provisional Patent Application Ser. No. 61/081,709, filed on Jul. 17, 2008, the entire contents of which are incorporated herein by reference.

In a third step 140 of the sequence of FIG. 1, the hydrocarbon-containing material 110 is exposed to charged particles or photons, such as photons having a wavelength between about 0.01 nm and 280 nm. In some embodiments, the photons can have a wavelength between, e.g., 100 nm to 280 nm or between 0.01 nm to 10 nm, or in some cases less than 0.01 nm. The charged particles interact with material 110, causing further disassociation of the hydrocarbons therein from the non-hydrocarbon materials, and also causing various hydrocarbon chemical processes, including chain scission, bond-formation, and isomerization. These chemical processes convert long-chain hydrocarbons into shorter-chain hydrocarbons, many of which can eventually be extracted from material 110 as products and used directly for various applications. The chemical processes can also lead to conversion of various products into other products, some of which may be more desirable than others. For example, through bond-forming reactions, some short-chain hydrocarbons may be converted to medium-chain-length hydrocarbons, which can be more valuable products. As another example, isomerization can lead to the formation of straight-chain hydrocarbons from cyclic hydrocarbons. Such straight-chain hydrocarbons may be more valuable products than their cyclized counterparts.

By adjusting an average energy of the charged particles and/or an average current of the charged particles, the total amount of energy delivered or transferred to material 110 by the charged particles can be controlled. In some embodiments, for example, material 110 can be exposed to charged particles so that the energy transferred to material 110 (e.g., the energy dose applied to material 110) is 0.3 Mrad or more (e.g., 0.5 Mrad or more, 0.7 Mrad or more, 1.0 Mrad or more, 2.0 Mrad or more, 3.0 Mrad or more, 5.0 Mrad or more, 7.0 Mrad or more, 10.0 Mrad or more, 15.0 Mrad or more, 20.0 Mrad or more, 30.0 Mrad or more, 40.0 Mrad or more, 50.0 Mrad or more, 75.0 Mrad or more, 100.0 Mrad or more, 150.0 Mrad or more, 200.0 Mrad or more, 250.0 Mrad or more, or even 300.0 Mrad or more).

In general, electrons, ions, photons, and combinations of these can be used as the charged particles in step 140 to process material 110. A wide variety of different types of ions can be used including, but not limited to, protons, hydride ions, oxygen ions, carbon ions, and nitrogen ions. These charged particles can be used under a variety of conditions; parameters such as particle currents, energy distributions, exposure times, and exposure sequences can be used to ensure that the desired extent of separation of the hydrocarbon components from the non-hydrocarbon components in material 110, and the extent of the chemical conversion processes among the hydrocarbon components, is reached. Suitable systems and methods for exposing material 110 to charged particles are discussed, for example, in the following U.S. Provisional Patent Application Ser. No. 61/049,406, filed on Apr. 30, 2008; Ser. No. 61/073,665, filed on Jun. 18, 2008; and Ser. No. 61/073,680, filed on Jun. 18, 2008. The entire contents of each of the foregoing provisional applications are incorporated herein by reference. In particular, charged particle systems such as inductive linear accelerator (LINAC) systems can be used to deliver large doses of energy (e.g., doses of 50 Mrad or more) to material 110.

In the final step of the processing sequence of FIG. 1, the processed material 110 is subjected to a separation step 150, which separates the hydrocarbon products 160 and the non-hydrocarbon products 170. A wide variety of different processes can be used to separate the products. Exemplary processes include, but are not limited to, distillation, extraction, and mechanical processes such as centrifugation, filtering, and agitation. In general, any process or combination of processes that yields separation of hydrocarbon products 160 and non-hydrocarbon products 170 can be used in step 150. A variety of suitable separation processes are discussed, for example, in PCT Publication No. WO 2008/073186 (e.g., in the Post-Processing section), the entire contents of which are incorporated herein by reference.

The processing sequence shown in FIG. 1 is a flexible sequence, and can be modified as desired for particular materials 110 and/or to recover particular hydrocarbon products 160. For example, the order of the various steps can be changed in FIG. 1. Further, additional steps of the types shown, or other types of steps, can be included at any point within the sequence, as desired. For example, additional mechanical processing steps, cooling/temperature-cycling steps, particle beam exposure steps, and/or separation steps can be included at any point in the sequence. Further, other processing steps such as sonication, chemical processing, pyrolysis, oxidation and/or reduction, and radiation exposure can be included in the sequence shown in FIG. 1 prior to, during, and/or following any of the steps shown in FIG. 1. Many processes suitable for inclusion in the sequence of FIG. 1 are discussed, for example, in PCT Publication No. WO 2008/073186 (e.g., throughout the Detailed Description section).

As an example, in some embodiments, material 110 can be subjected to one or more sonication processing steps as part of the processing sequence shown in FIG. 1. One or more liquids can be added to material 110 to assist the sonication process. Suitable liquids that can be added to material 110 include, for example, water, various types of liquid hydrocarbons (e.g., hydrocarbon solvents), and other common organic and inorganic solvents.

Material 110 is sonicated by introducing the material into a vessel that includes one or more ultrasonic transducers. A generator delivers electricity to the one or more ultrasonic transducers, which typically include piezoelectric elements that convert the electrical energy into sound in the ultrasonic range. In some embodiments, the materials are sonicated using sound waves having a frequency of from about 16 kHz to about 110 kHz, e.g., from about 18 kHz to about 75 kHz or from about 20 kHz to about 40 kHz (e.g., sound having a frequency of 20 kHz to 40 kHz).

The ultrasonic energy (in the form of ultrasonic waves) is delivered or transferred to material 110 in the vessel. The energy creates a series of compressions and rarefactions in material 110 with an intensity sufficient to create cavitation in material 110. Cavitation disaggregates the hydrocarbon and non-hydrocarbon components of material 110, and also produces free radicals in material 110. The free radicals act to break down the hydrocarbon components in material 110 by initiating bond-cleaving reactions.

Typically, 5 to 4000 $MJ/m^3$, e.g., 10, 25, 50, 100, 250, 500, 750, 1000, 2000, or 3000 $MJ/m^3$, of ultrasonic energy is delivered or applied to material 110 moving at a rate of about 0.2 $m^3/s$ (about 3200 gallons/min) through the vessel. After exposure to ultrasonic energy, material 110 exits the vessel and is directed to one or more additional process steps.

As discussed briefly previously, in step 140 of the sequence of FIG. 1, exposure to charged particles or photons is performed in the presence of various solid components in material 110. The solid components can carry the hydrocarbon components in a variety of ways. For example, the hydrocarbons can be adsorbed onto the solid materials, supported by the solid materials, impregnated within the solid materials, layered on top of the solid materials, mixed with the solid materials to form a tar-like heterogeneous mixture, and/or combined in various other ways. During exposure of material 110 to charged particles, the solid components enhance the effectiveness of exposure. The solid components can be composed mainly of inorganic materials having poor thermal conductivity (e.g., silicates, oxides, aluminas, aluminosilicates, and other such materials).

When material 110 is exposed to charged particles or photons, the charged particles or photons act directly on the hydrocarbons to cause a variety of chemical processes, as discussed above. However, the charged particles also transfer kinetic energy in the form of heat to the solid components of material 110. Because the solid components have relatively poor thermal conductivity, the transferred heat remains in a region of the solid material very close to the position at which the charged particles are incident. Accordingly, the local temperature of the solid material in this region increases rapidly to a large value. The hydrocarbon components, which are in contact with the solid components, also increase rapidly to a significantly higher temperature. At elevated temperature, the rates of reactions initiated in the hydrocarbons by the charged particles—chain scission (e.g., cracking), bond-forming, isomerization, oxidation and/or reduction—are typically enhanced, leading to more efficient separation of the hydrocarbons from the solid components, and more efficient conversion of the hydrocarbons into desired products.

Overall, the solid components present in material 110 actually promote, rather than discourage, the separation and conversion of the hydrocarbons in the material using the methods disclosed herein. In some embodiments, material 110 is heated during exposure to charged particles to an average temperature of 300 K or more (e.g., 325 K or more, 350 K or more, 400 K or more, 450 K or more, 500 K or more, 600 K or more, 700 K or more). Further, when the solid components include one or more types of metal particles (e.g., dopants), the rates and/or efficiencies of various chemical reactions occurring in material 110 can be still further enhanced, for example due to participation of the metals as catalysts in the reactions.

To further increase the rate and/or selectivity of the process shown in FIG. 1, one or more catalyst materials can also be introduced. Catalyst materials can be introduced in a variety of ways. For example, in some embodiments, in step 140 (or another comparable step in which material 110 is treated with charged particles), the charged particles can include particles of catalytic materials in addition to, or as alternatives to, other ions and/or electrons. Exemplary catalytic materials can include ions and/or neutral particles of various metals including platinum, rhodium, osmium, iron, and cobalt.

In certain embodiments, the catalytic materials can be introduced directly into the solid components of material 110. For example, the catalytic materials can be mixed with material 110 (e.g., by combining material 110 with a solution that includes the catalytic materials) prior to exposure of material 110 to charged particles in step 140.

In some embodiments, the catalytic materials can be added to material 110 in solid form. For example, the catalytic materials can be carried by a solid supporting material (e.g., adsorbed onto the supporting material and/or impregnated within the supporting material) and then the solid supporting material with the catalytic materials can be combined with material 110 prior to exposure step 140. As a result of any of the processes of introducing the catalyst material into the solid components of material 110, when material 110 is exposed to charged particles in step 140, the hydrocarbon components are carried by one or more solid materials that include one or more catalytic materials. In general, the catalytic materials can be carried (e.g., adsorbed) on internal surfaces of the solid supporting material, on external surfaces of the solid supporting material, or on both internal and external surfaces of the solid supporting material.

In certain embodiments, additional solid material can be added to material 110 prior to exposing material 110 to charged particles. The added solid material can include one or more different types of solid materials. As discussed above, by adding additional solid materials, local heating of the hydrocarbon components can be enhanced, increasing the rate and/or selectivity of the reactions initiated by the charged particles.

Typically, the added solid materials have relatively low thermal conductivity, to ensure that local heating of the hydrocarbons in material 110 occurs, and to ensure that heat dissipation does not occur too quickly. In some embodiments, the thermal conductivity of one or more solid materials added to material 110 prior to a step of exposing material 110 to charged particles is 5 W $m^{-1}$ $K^{-1}$ or less (e.g., 4 W $m^{-1}$ $K^{-1}$ or less, 3 W $m^{-1}$ $K^{-1}$ or less, 2 W $m^{-1}$ $K^{-1}$ or less, 1 W $m^{-1}$ $K^{-1}$ or less, or 0.5 W $m^{-1}$ $K^{-1}$ or less). Exemplary solid materials that can be added to material 110 include, but are not limited to, silicon-based materials such as silicates, silicas, aluminosilicates, aluminas, oxides, various types of glass particles, and various types of stone (e.g., sandstone), rock, and clays, such as smectic clays, e.g., montmorillonite and bentonite.

In some embodiments, one or more zeolite materials can be added to material 110 prior to exposure of material 110 to charged particles. Zeolite materials are porous, and the pores can act as host sites for both catalytic materials and hydrocarbons. A large number of different zeolites are available and compatible with the processes discussed herein. Methods of making zeolites and introducing catalytic materials into zeolite pores are disclosed, for example, in the following patents, the entire contents of each of which are incorporated herein by reference: U.S. Pat. Nos. 4,439,310; 4,589,977; 7,344,695; and European Patent No. 0068817. Suitable zeolite materials are available from, for example, Zeolyst International (Valley Forge, Pa., http://www.zeolyst.com).

In certain embodiments, one or more materials can be combined with material 110 prior to exposing material 110 to charged particles. The combined materials form a precursor material. The one or more materials can include reactive substances that are present in a chemically inert form. When the reactive substances are exposed to charged particles (e.g., during step 140), the inert forms can be converted to reactive forms of the substances. The reactive substances can then participate in the reactions of the hydrocarbon components of material 110, enhancing and rates and/or selectivity of the reactions. Exemplary reactive substances include oxidizing agents (e.g., oxygen atoms, ions, oxygen-containing molecules such as oxygen gas and/or ozone, silicates, nitrates, sulfates, and sulfites), reducing agents (e.g., transition metal-based compounds), acidic and/or basic agents, electron donors and/or acceptors, radical species, and other types of chemical intermediates and reactive substances.

In some embodiments, solid materials can be added to material 110 until a weight percentage of solid components in material 110 is 2% or more (e.g., 5% or more, 10% or more, 15% or more, 20% or more, 30% or more, 40% or more, 50% or more, 60% or more, 70% or more, or 80% or more). As discussed above, in certain embodiments, exposing the hydrocarbons to charged particles when the hydrocarbons are carried by solid materials can enhance the rate and/or selectivity of the reactions initiated by the charged particles.

In some embodiments, an average particle size of the solid components of material 110 can be between 50 μm and 50 mm (e.g., between 50 μm and 65 mm, between 100 μm and 10 mm, between 200 μm and 5 mm, between 300 μm and 1 mm, between 0.06 mm and 2 mm, or between 500 μm and 1 mm). In general, by controlling an average particle size of the solid components, the ability of the solid components to support hydrocarbon-containing materials can be controlled. In some instances, catalytic activity of the solid components can also be controlled by selecting suitable average particle sizes.

The average particle size of the solid components of material 110 can be controlled via various optional mechanical processing techniques in step 120 of FIG. 1. For example, in some embodiments, the average particle size of material 110 can be reduced sufficiently so that material 110 is pourable and flows like granulated sugar, sand, or gravel.

In certain embodiments, a surface area per unit mass of solid materials added to material 110 is 250 $m^2$ per g or more (e.g., 400 $m^2$ per g or more, 600 $m^2/g$ or more, 800 $m^2/g$ or more, 1000 $m^2/g$ or more, 1200 $m^2/g$ or more). Generally, by adding solid materials with higher surface areas, the amount of hydrocarbon material that can be carried by the solid components of material 110 increases. Further, the amount of catalyst material that can be carried by the solid components of material 110 also increases, and/or the number of catalytic sites on the solid materials increases. As a result of these factors, the overall rate and selectivity of the chemical reactions initiated by charged particle exposure can be enhanced.

In some embodiments, a weight percentage of catalyst material in the solid components of material 110 can be 0.001% or more (e.g., 0.01% or more, 0.1% or more, 0.3% or more, 0.5% or more, 1.0% or more, 2.0% or more, 3.0% or more, 4.0% or more, 5.0% or more, or 10.0% or more). The catalyst material can include a single type of catalyst, or two or more different types of catalysts.

In general, a wide variety of different types of charged particles can be used to expose material 110. The charged particles can include, for example, electrons, negatively charged ions, and positively charged ions. The charged particles can include ions of hydrogen, oxygen, carbon, nitrogen, noble metals, transition metals, and a variety of other monatomic and polyatomic ions. The ions can be singly-charged and/or multiply-charged.

In certain embodiments, one or more different types of reactive particles can be introduced into the process prior to, during, or following one or more charged particle exposure steps. Suitable reactive particles include oxygen, ozone, sulfur, selenium, various metals, noble gases (including noble gas ions), and hydride ions. Reactive particles assist in further enhancing the rate and selectivity of processes initiated by the charged particles (e.g., chain scission, bond forming, functionalization, and isomerization).

In some embodiments, the steps shown in FIG. 1 can be performed without adding any liquids, e.g., solvents, during processing. There can be significant advantages to processing material 110 without adding liquids; these include no need for used liquid disposal and/or recycling problems and equipment, no need for a fluid pumping and transport system for moving material 110 through the processing system, and simpler material handling procedures. Further, liquid-free (e.g., solvent-free) processing of material 110 can also be significantly less expensive than liquid-based processing methods when large volumes of material 110 are processed.

In certain other embodiments, some or all of the steps shown in FIG. 1 can be performed in the presence of a liquid such as a solvent, an emulsifier, or more generally, one or more liquids that are mixed with material 110. For example, in some embodiments, one or more liquids such as water, one or more liquid hydrocarbons, and/or other organic and/or inorganic solvents of hydrocarbons can be combined with material 110 to improve the ability of material 110 to flow. By mixing one or more liquids with material 110, a heterogeneous suspension of solid material in the liquids can be formed. The suspension can be readily transported from one location to another in a processing facility via conventional pressurized piping apparatus. The added liquids can also assist various processes (e.g., sonication) in breaking up the solid material into smaller particles during processing.

In certain embodiments, the methods disclosed herein can be performed within conventional crude oil processing apparatus. For example, some or all of the processing steps in FIG. 1 can be performed in a fluidized bed system. Material 110 can be subjected to mechanical processing and/or cooling/thermal-cycling steps and introduced into a fluidized bed. Charged particles can be delivered into the fluidized bed system, and material 110 can be exposed to the charged particles. The charged particles can include one or more different types of catalytic particles (e.g., particles of metals such as platinum, rhodium, osmium, iron, cobalt) which can further enhance the rate and/or selectivity of the chemical reactions initiated by the charged particles. Reactive particles can also be delivered into the fluidized bed environment to promote the reactions. Exemplary reactive particles include, but are not limited to, oxygen, ozone, sulfur, selenium, various metals, noble gas ions, and hydride ions.

In some embodiments, the methods disclosed herein can be performed in catalytic cracking apparatus. Following processing of material 110 (e.g., via mechanical processing steps and/or cooling/temperature-cycling), material 110 can be introduced into a catalytic cracking apparatus. Charged particles can be delivered to the catalytic cracking apparatus and used to expose material 110. Further, reactive particles (as discussed above in connection with fluidized bed systems) can be introduced into the catalytic cracking apparatus to improve the rate and/or selectivity of the reactions initiated by the charged particles. Hydrocarbon components of material 110 can undergo further cracking reactions in the apparatus to selectively produce desired products.

In other embodiments, the methods disclosed herein can be performed in situ, e.g., in a wellbore or other mining site. For example, in some implementations a source of radiation is introduced into a wellbore to irradiate a hydrocarbon-containing material within the wellbore. The source of radiation can be, for example an electron gun, such as a Rhodotron® accelerator.

In some cases, for example if a plurality of lateral wellbores are drilled in the formation and electrons are introduced through each lateral, the electron gun may be used by itself. In such instances, while the electrons do not penetrate deeply into the formation surrounding the laterals, they penetrate relatively shallowly over the entire length of each lateral, thereby penetrating a considerable area of the formation. It is important that electrons be able to penetrate into the formation. Accordingly, for example, the lateral wellbores may be unlined, may be lined after irradiation, may be lined with a liner that is perforated sufficiently to allow adequate penetration of radiation, or may be lined with a liner that transmits radiation, e.g., a PVC pipe.

In other cases, when deeper penetration is desired, the source of radiation can be configured to emit x-rays or other high energy photons, e.g., gamma rays that are able to penetrate the formation more deeply. For example, the source of radiation can be an electron gun used in combination with a metal foil, e.g., a tantalum foil, to generate bremssthrahlung x-rays. Electron guns of this type are commercially available, e.g., from IBA Industrial under the tradename eXelis®.

Typically, such devices are housed in a vault, e.g., of lead or concrete.

Various other irradiating devices may be used in the methods disclosed herein, including field ionization sources, electrostatic ion separators, field ionization generators, thermionic emission sources, microwave discharge ion sources, recirculating or static accelerators, dynamic linear accelerators, van de Graaff accelerators, and folded tandem accelerators. Such devices are disclosed, for example, in U.S. Provisional Application Ser. No. 61/073,665, the complete disclosure of which is incorporated herein by reference.

Alternatively, cobalt 60 can be used to generate gamma rays. However, for safety reasons it is important that the cobalt 60 be shielded when it could be exposed to humans. Thus, in such implementations the cobalt 60 should generally be shielded when it is not confined in a wellbore or other closed formation.

Referring to FIGS. 4 and 4A, a subsurface formation production system is shown generally at 10 and includes one or more primary wellbores 12 that are lined with a string of well casing 14. The primary wellbores 12 intersect a subsurface production formation 16 from which hydrocarbon-containing materials are to be produced.

An injection tubing string 18 extends from the surface through the well or casing 14 and is secured in place by packers 20 and 22 or by any other suitable means for support and orientation within the wellbore. The lower, open end 24 of the injection tubing string 18 is in communication with an injection compartment 26 within the well or casing which is isolated, e.g., by packers 22 and 28 that establish sealing within the well or casing.

An array of laterally oriented injection passages 30 and 32 that are formed within the production formation 16 extend from the isolated injection compartment 26. Passages 30, 32 extend from openings or windows 34 and 36 that are formed in the well or casing 14 by a suitable drilling, milling or cutting tool or by any other suitable means.

Figure 3:
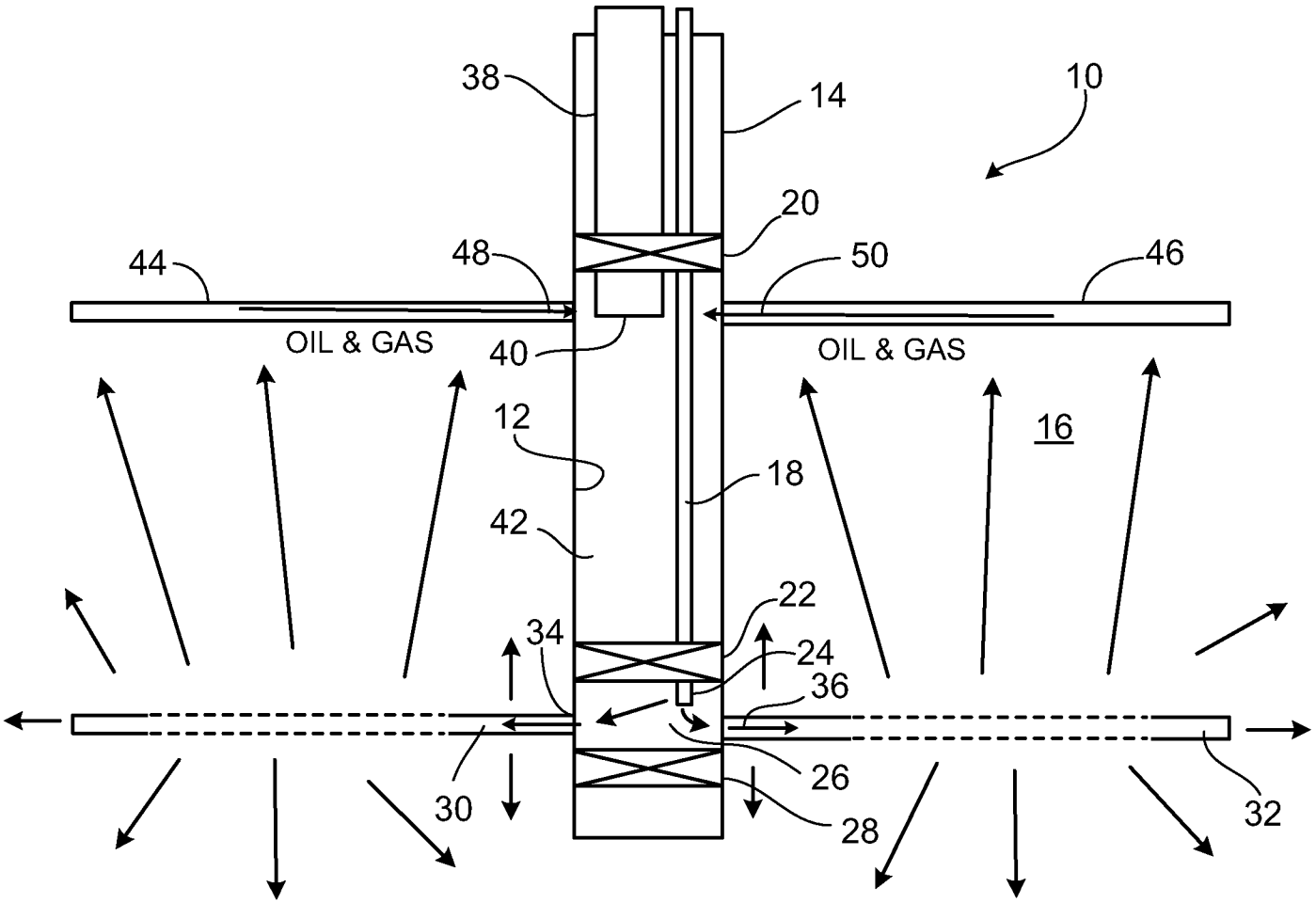
FIG. 3 is a schematic illustration of the lower portion of a well, intersecting a production formation and having a system for injecting radiation into the formation.

Referring to FIG. 3, the formation can be irradiated by passing a source of radiation through the injection tubing string 18, for example an electron gun as discussed above. Irradiation of the formation will cause a reduction in the molecular weight of the hydrocarbon-containing materials in the formation, thereby reducing the viscosity of the hydrocarbons.

A downhole pump can be provided for pumping the collected production fluid to the surface; however in many cases production of the well is caused by injection pressure or steam pressure.

Figure 3A:
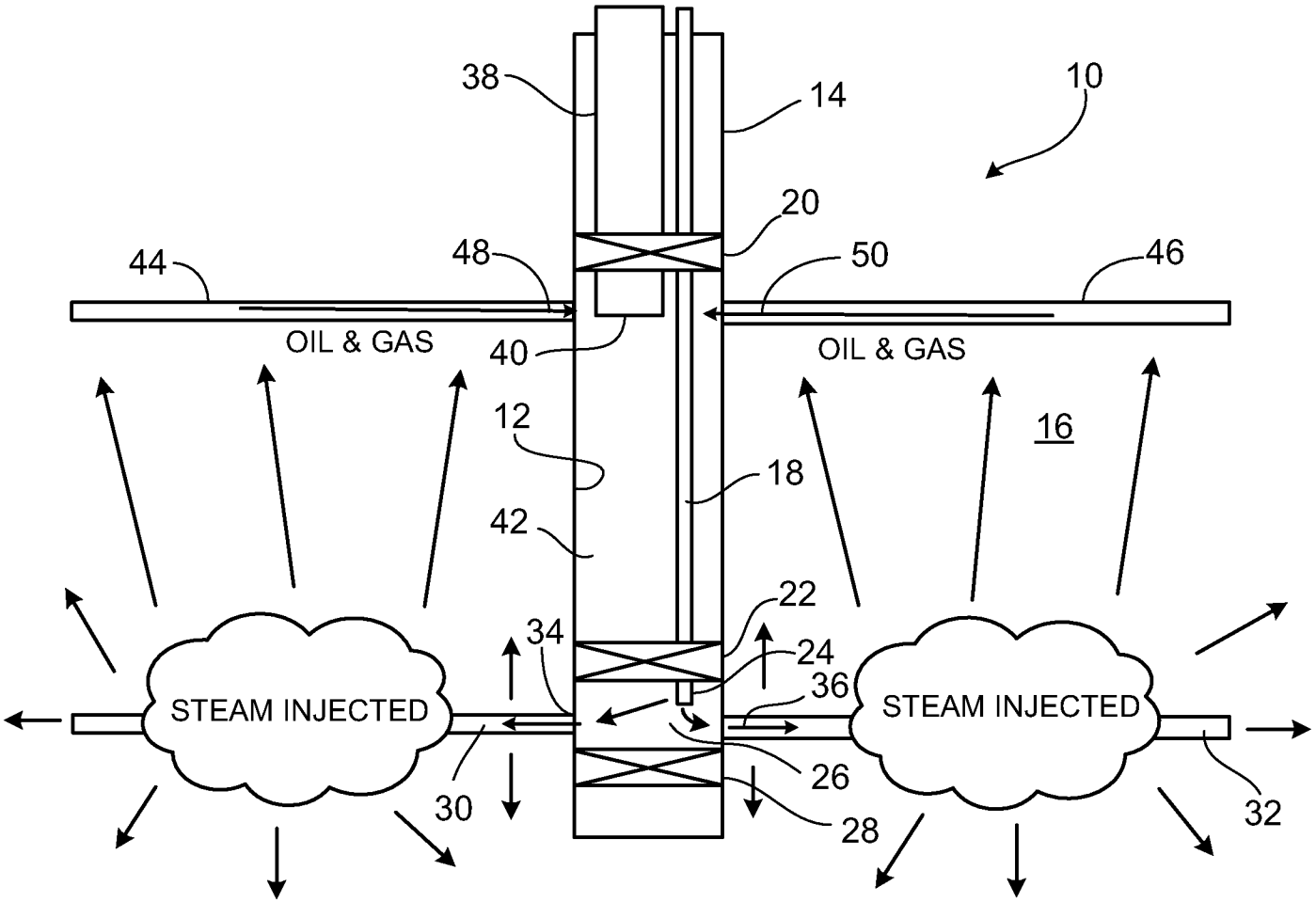
FIG. 3A is a schematic illustration of the lower portion of the same well, showing injection of steam and/or chemical constituents into the formation and producing the well via a production conduit of the well.

Accordingly, if desired, steam may be used after irradiation to aid in production of the hydrocarbon-containing materials from the wellbore. Referring now to FIG. 3A, in some implementations steam from a suitable source located at the surface (not shown) can be injected through the injection tubing string 18 into the injection compartment 26 of the well or casing 14. From the injection compartment 26 the steam enters the array of injection passages 30 and 32 and enters the subsurface production formation where it heats the hydrocarbon-containing material and reduces its viscosity and also pressurizes the production formation. The formation pressure induced by the pressure of the steam causes the heated and less viscous hydrocarbon-containing material to migrate through the formation toward a lower pressure zone where it can be acquired and produced.

While only two radially or laterally oriented injection passages 30 and 32 are shown in FIG. 3A, it will be apparent that any suitable number of injection passages or bores may be formed. The injection passages may be formed through the use of various commercially available processes.

In many applications, to minimize the potential for sloughing of formation material into previously jetted lateral passages it is desirable to conduct post jetting liner washing operations where a perforate i.e., slotted liner is washed into place to provide formation support and to also provide for injection of fluid and provide for flow of formation fluid to the wellbore for production. As discussed above, if the liner is inserted prior to the irradiation step discussed above, it is important that the liner be constructed to allow the radiation to penetrate into the formation.

For production of the well, a production tubing string 38 extends from the surface through an open hole or through the casing string 14 and is secured by the packer 20 or by any suitable anchor device. The lower open end 40 of the production tubing string extends below the packer 20 and is open to a production compartment 42 within the well or casing 14 that is isolated by the packers 20 and 22. Typically, a pump will be located to pump collected formation fluid from the production compartment and through the production tubing to the surface; however in some cases the formation pressure, being enhanced by steam or injected fluid pressure will cause flow of the production fluid to the surface to fluid handling equipment at the surface.

A plurality of lateral production passages or bores, two of which are shown at 44 and 46, extend into the production formation 16 from openings or windows 48 and 50 that are formed in the well or casing. The production passages may be un-lined as shown in FIG. 3, or lined by a flexible perforated liner as is well known, depending on the characteristics of the production formation. The lateral production passages 44 and 46 are open to the production compartment 42 of the well or casing. The heat and formation pressure induced by the pressure of the steam causes the heated and therefore less viscous hydrocarbon-containing materials to migrate through the formation to the lateral production passages 44 and 46 which conduct the produced materials through the openings or windows 48 and 50 into the production compartment 42 of the well casing. When a pump is not employed, the produced material is then forced by the formation pressure into the production tubing 38 which conducts it to the surface where it is then received by surface equipment "P" for further processing and for storage, handling or transportation.

In some cases, for example if the hydrocarbon-containing material is near the surface, it may not be necessary to apply steam or other heat to extract the hydrocarbon. For example, in some instances the hydrocarbon-containing material can be irradiated in situ and then removed without heating, e.g., by strip mining.

The hydrocarbons 160 produced from the process shown in FIG. 1 are typically less viscous and flow more easily than original material 110 prior to the beginning of processing. Accordingly, the process shown in FIG. 1 permits extraction of flowable components from material 110, which can greatly simplify subsequent handling of the hydrocarbons. However, not all of the steps shown in FIG. 1 are required for processing material 110 to obtain hydrocarbon components 160, depending upon the nature of material 110. For some materials, for example, direct exposure to charged particles (step 140), followed by separation (step 150) is a viable route to obtaining hydrocarbons 160. For certain materials, direct exposure to catalytic particles (e.g., neutral particles and/or ions of materials such as platinum, rhodium, osmium, iron and cobalt) in step 140, followed by separation (step 150) can be used to obtain hydrocarbons 160.

Figure 2:
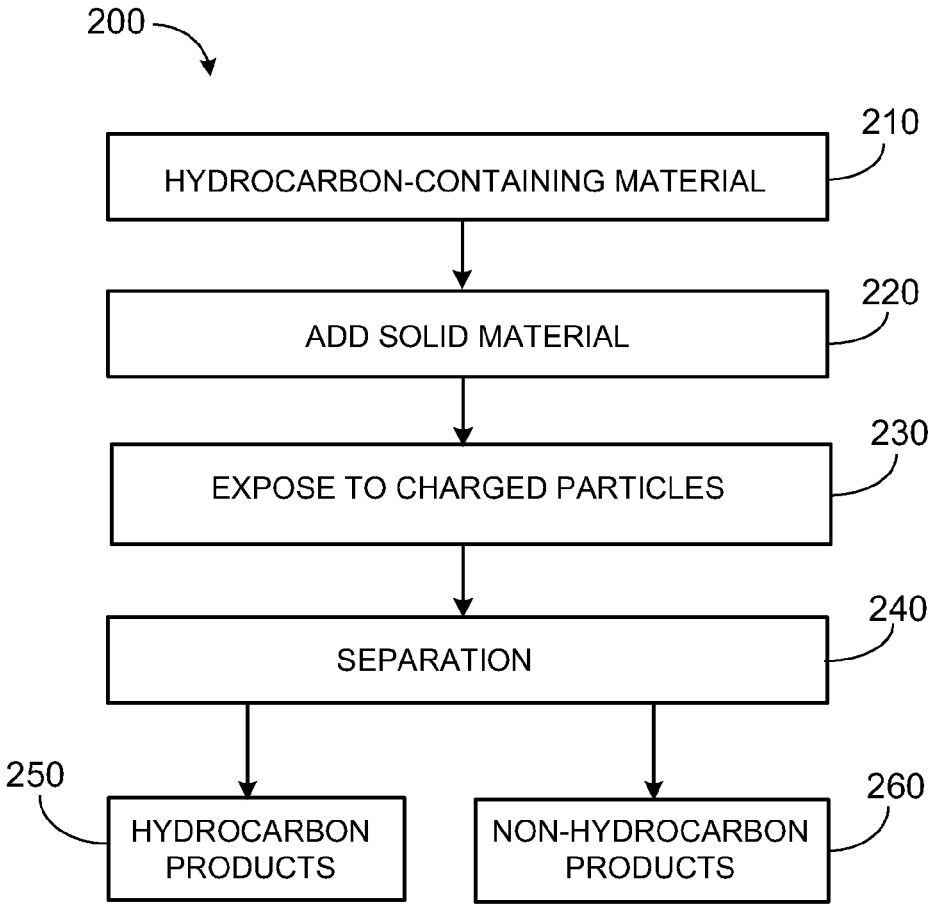
FIG. 2 is a schematic diagram showing another sequence of steps for processing hydrocarbon-containing materials.

Although the preceding discussion has focused on processing of materials that include both hydrocarbons and non-hydrocarbon components, the methods disclosed herein can also be used to processed materials that include, at least nominally, primarily hydrocarbons, such as various grades of crude oil. FIG. 2 is a schematic diagram showing a series of steps 200 that can be used to process such materials. In a first step 220, hydrocarbon 210 is combined with a quantity of solid material to form a heterogeneous mixture. The solid material can include any one or more of the solid materials disclosed herein. The solid material(s) can also include any one or more of the catalyst materials disclosed herein. The added solids form a carrier for hydrocarbon 210, and also provide an active surface for any catalytic steps.

In step 230, hydrocarbon 210 is exposed to charged particles (e.g., electrons and/or ions). Local heating due to charged particle exposure and relatively slow thermal dissipation due to the poor thermal conductivity of the added solid materials increases the temperature of hydrocarbon 210, leading to enhanced rates and selectivity of the reactions initiated by the charged particles. Catalytic particles, present in the added solid materials and/or the charged particles, further enhance reaction rates and specificity. In general, the conditions during the exposure step 230 can be selected according to the discussion of step 140 in FIG. 1 above. In the final step 240 of FIG. 2, hydrocarbon products 250 and non-hydrocarbon products 260 are separated using any one or more of the procedures discussed above in connection with step 150 of FIG. 1.

Hydrocarbon products, whether extracted from hydrocarbon-containing materials with solid components (e.g., process 100) or extracted from hydrocarbon sources such as crude oils (e.g., process 200), can be further processed via conventional hydrocarbon processing methods. Where hydrocarbons were previously associated with solid components in materials such as oil sands, tar sands, and oil shale, the liberated hydrocarbons are flowable and are therefore amenable to processing in refineries.

In general, the methods disclosed herein can be integrated within conventional refineries to permit processing and refining of hydrocarbons from alternative sources. The methods can be implemented before, during, and/or after any one or more conventional refinery processing steps. Further, certain aspects of the methods disclosed herein, including exposure of hydrocarbons to charged particles, can be used to assist conventional refining methods, improving the rate and selectivity of these methods. In the following discussion, further refining methods that can be used to process hydrocarbons 160 and/or 250 (e.g., the mixtures of products obtained from processes 100 and 200) are described.

Hydrocarbon refining comprises processes that separate various components in hydrocarbon mixtures and, in some cases, convert certain hydrocarbons to other hydrocarbon species via molecular rearrangement (e.g., chemical reactions that break bonds). In some embodiments, a first step in the refining process is a water washing step to remove soluble components such as salts from the mixtures. Typically, the washed mixture of hydrocarbons is then directed to a furnace for preheating. The mixture can include a number of different components with different viscosities; some components may even be solid at room temperature. By heating, the component mixture can be converted to a mixture that can be more easily flowed from one processing system to another (and from one end of a processing system to the other) during refining.

The preheated hydrocarbon mixture is then sent to a distillation tower, where fractionation of various components occurs with heating in a distillation column. The amount of heat energy supplied to the mixture in the distillation process depends in part upon the hydrocarbon composition of the mixture; in general, however, significant energy is expended in heating the mixture during distillation, cooling the distillates, pressurizing the distillation column, and in other such steps. Within limits, certain refineries are capable of reconfiguration to handle differing hydrocarbon mixtures and to produce products. In general, however, due to the relatively specialized refining apparatus, the ability of refineries to handle significantly different feedstocks is restricted.

In some embodiments, pretreatment of hydrocarbon mixtures using methods disclosed in the publications incorporated herein by reference, such as ion beam pretreatment (and/or one or more additional pretreatments), can enhance the ability of a refining apparatus to accept hydrocarbon mixtures having different compositions. For example, by exposing a mixture to incident ions from an ion beam, various chemical and/or physical properties of the mixture can be changed. Incident ions can cause chemical bonds to break, leading to the production of lighter molecular weight hydrocarbon components with lower viscosities from heavier components with higher viscosities. Alternatively, or in addition, exposure of certain components to ions can lead to isomerization of the exposed components. The newly formed isomers can have lower viscosities than the components from which they are formed. The lighter molecular weight components and/or isomers with lower viscosities can then be introduced into the refinery, enabling processing of mixtures which may not have been suitable for processing initially.

In general, the various components of hydrocarbon mixtures distill at different temperature ranges, corresponding to different vertical heights in a distillation column. Typically, for example, a refinery distillation column will include product streams at a large number of different temperature cut ranges, with the lowest boiling point (and, generally, smallest molecular weight) components drawn from the top of the column, and the highest boiling point, heaviest molecular weight components, drawn from lower levels of the column. As an example, light distillates extracted from upper regions of the column typically include one or more of aviation gasoline, motor gasoline, naphthas, kerosene, and refined oils. Intermediate distillates, removed from the middle region of the column, can include one or more of gas oil, heavy furnace oil, and diesel fuel oil. Heavy distillates, which are generally extracted from lower levels of the column, can include one or more of lubricating oil, grease, heavy oils, wax, and cracking stock. Residues remaining in the still can include a variety of high boiling point components such as lubricating oil, fuel oil, petroleum jelly, road oils, asphalt, and petroleum coke. Certain other products can also be extracted from the column, including natural gas (which can be further refined and/or processed to produce components such as heating fuel, natural gasoline, liquefied petroleum gas, carbon black, and other petrochemicals), and various by-products (including, for example, fertilizers, ammonia, and sulfuric acid).

Generally, treatment of hydrocarbon mixtures using the methods disclosed (including, for example, ion beam treatment, alone or in combination with one or more other methods) can be used to modify molecular weights, chemical structures, viscosities, solubilities, densities, vapor pressures, and other physical properties of the treated materials. Typical ions that can be used for treatment of hydrocarbon mixtures can include protons, carbon ions, oxygen ions, and any of the other types of ions disclosed herein. In addition, ions used to treat hydrocarbon mixtures can include metal ions; in particular, ions of metals that catalyze certain refinery processes (e.g., catalytic cracking) can be used to treat hydrocarbon mixtures. Exemplary metal ions include, but are not limited to, platinum ions, palladium ions, iridium ions, rhodium ions, ruthenium ions, aluminum ions, rhenium ions, tungsten ions, and osmium ions.

In some embodiments, multiple ion exposure steps can be used. A first ion exposure can be used to treat a hydrocarbon mixture to effect a first change in one or more of molecular weight, chemical structure, viscosity, density, vapor pressure, solubility, and other properties. Then, one or more additional ion exposures can be used to effect additional changes in properties. As an example, the first ion exposure can be used to convert a substantial fraction of one or more high boiling, heavy components to lower molecular weight compounds with lower boiling points. Then, one or more additional ion exposures can be used to cause precipitation of the remaining amounts of the heavy components from the component mixture.

In general, a large number of different processing protocols can be implemented, according to the composition and physical properties of the mixture. In certain embodiments, the multiple ion exposures can include exposures to only one type of ion. In some embodiments, the multiple ion exposures can include exposures to more than one type of ion. The ions can have the same charges, or different charge magnitudes and/or signs.

In certain embodiments, the mixture and/or components thereof can be flowed during exposure to ion beams. Exposure during flow can greatly increase the throughput of the exposure process, enabling straightforward integration with other flow-based refinery processes.

In some embodiments, the hydrocarbon mixtures and/or components thereof can be functionalized during exposure to ion beams. For example, the composition of one or more ion beams can be selected to encourage the addition of particular functional groups to certain components (or all components) of a mixture. One or more functionalizing agents (e.g., ammonia) can be added to the mixture to introduce particular functional groups. By functionalizing the mixture and/or components thereof, ionic mobility within the functionalized compounds can be increased (leading to greater effective ionic penetration during exposure), and physical properties such as viscosity, density, and solubility of the mixture and/or components thereof can be altered. By altering one or more physical properties of the mixture and/or components, the efficiency and selectivity of subsequent refining steps can be adjusted, and the available product streams can be controlled. Moreover, functionalization of hydrocarbon components can lead to improved activating efficiency of catalysts used in subsequent refining steps.

In general, the methods disclosed herein—including ion beam exposure of hydrocarbon mixtures and components—can be performed before, during, or after any of the other refining steps disclosed herein, and/or before, during, or after any other steps that are used to obtain the hydrocarbons from raw sources. The methods disclosed herein can also be used after refining is complete, and/or before refining begins.

In some embodiments, when hydrocarbon mixtures and/or components thereof are exposed to one or more ion beams, the exposed material can also be exposed to one or more gases concurrent with ion beam exposure. Certain components of the mixtures, such as components that include aromatic rings, may be relatively more stable to ion beam exposure than non-aromatic components. Typically, for example, ion beam exposure leads to the formation of reactive intermediates such as radicals from hydrocarbons. The hydrocarbons can then react with other less reactive hydrocarbons. To reduce the average molecular weight of the exposed material, reactions between the reactive products and less reactive hydrocarbons lead to molecular bond-breaking events, producing lower weight fragments from longer chain molecules. However, more stable reactive intermediates (e.g., aromatic hydrocarbon intermediates) may not react with other hydrocarbons, and can even undergo polymerization, leading to the formation of heavier weight compounds. To reduce the extent of polymerization in ion beam exposed hydrocarbon mixtures, one or more radical quenchers can be introduced before, during, and/or after ion beam exposure. The radical quenchers can cap reactive intermediates, preventing the re-formation of chemical bonds that have been broken by the incident ions. Suitable radical quenchers include hydrogen donors such as hydrogen gas.

In certain embodiments, reactive compounds can be introduced during ion beam exposure to further promote degradation of hydrocarbon components. The reactive compounds can assist various degradation (e.g., bond-breaking) reactions, leading to a reduction in molecular weight of the exposed material. An exemplary reactive compound is ozone, which can be introduced directly as a gas, or generated in situ via application of a high voltage to an oxygen-containing supply gas (e.g., oxygen gas or air) or exposure of the oxygen-containing supply gas to an ion beam and/or an electron beam. In some embodiments, ion beam exposure of hydrocarbon mixtures and/or components thereof in the presence of a fluid such as oxygen gas or air can lead to the formation of ozone gas, which also assists the degradation of the exposed material.

Prior to and/or following distillation in a refinery, hydrocarbon mixtures and/or components thereof can undergo a variety of other refinery processes to purify components and/or convert components into other products. In the following sections, certain additional refinery steps are outlined, and use of the methods disclosed herein in combination with the additional refinery steps will be discussed.

(i) Catalytic Cracking

Catalytic cracking is a widely used refinery process in which heavy oils are exposed to heat and pressure in the presence of a catalyst to promote cracking (e.g., conversion to lower molecular weight products). Originally, cracking was accomplished thermally, but catalytic cracking has largely replaced thermal cracking due to the higher yield of gasoline (with higher octane) and lower yield of heavy fuel oil and light gases. Most catalytic cracking processes can be classified as either moving-bed or fluidized bed processes, with fluidized bed processes being more prevalent. Process flow is generally as follows. A hot oil feedstock is contacted with the catalyst in either a feed riser line or the reactor. During the cracking reaction, the formation of coke on the surface of the catalyst progressively deactivates the catalyst. The catalyst and hydrocarbon vapors undergo mechanical separation, and oil remaining on the catalyst is removed by steam stripping. The catalyst then enters a regenerator, where it is reactivated by carefully burning off coke deposits in air. The hydrocarbon vapors are directed to a fractionation tower for separation into product streams at particular boiling ranges.

Older cracking units (e.g., 1965 and before) were typically designed with a discrete dense-phase fluidized catalyst bed in the reactor vessel, and operated so that most cracking occurred in the reactor bed. The extent of cracking was controlled by varying reactor bed depth (e.g., time) and temperature. The adoption of more reactive zeolite catalysts had led to improved modern reactor designs in which the reactor is operated as a separator to separate the catalyst and the hydrocarbon vapors, and control of the cracking process is achieved by accelerating the regenerated catalyst to a particular velocity in a riser-reactor before introducing it into the riser and injecting the feedstock into the riser.

The methods disclosed herein can be used before, during, and/or after catalytic cracking to treat hydrocarbon components derived from alternative sources such as oil shale, oil sands, and tar sands. In particular, ion beam exposure (alone, or in combination with other methods) can be used to pre-treat hydrocarbons prior to injection into the riser, to treat hydrocarbons (including hydrocarbon vapors) during cracking, and/or to treat the products of the catalytic cracking process.

Cracking catalysts typically include materials such as acid-treated natural aluminosilicates, amorphous synthetic silica-alumina combinations, and crystalline synthetic silica-alumina catalysts (e.g., zeolites). During the catalytic cracking process, hydrocarbon components can be exposed to ions from one or more ion beams to increase the efficiency of these catalysts. For example, the hydrocarbon components can be exposed to one or more different types of metal ions that improve catalyst activity by participating in catalytic reactions. Alternatively, or in addition, the hydrocarbon components can be exposed to ions that scavenge typical catalyst poisons such as nitrogen compounds, iron, nickel, vanadium, and copper, to ensure that catalyst efficiency remains high. Moreover, the ions can react with coke that forms on catalyst surfaces to remove the coke (e.g., by processes such as sputtering, and/or via chemical reactions), either during cracking or catalyst regeneration.

(ii) Alkylation

In petroleum terminology, alkylation refers to the reaction of low molecular weight olefins with an isoparaffin (e.g., isobutane) to form higher molecular weight isoparaffins. Alkylation can occur at high temperature and pressure without catalysts, but commercial implementations typically include low temperature alkylation in the presence of either a sulfuric acid or hydrofluoric acid catalyst. Sulfuric acid processes are generally more sensitive to temperature than hydrofluoric acid based processes, and care is used to minimize oxidation-reduction reactions that lead to the formation of tars and sulfur dioxide. In both processes, the volume of acid used is typically approximately equal to the liquid hydrocarbon charge, and the reaction vessel is pressurized to maintain the hydrocarbons and acid in a liquid state. Contact times are generally from about 10 to 40 minutes, with agitation to promote contact between the acid and hydrocarbon phases. If acid concentrations fall below about 88% by weight sulfuric acid or hydrofluoric acid, excessive polymerization can occur in the reaction products. The use of large volumes of strong acids makes alkylation processes expensive and potentially hazardous.

The methods disclosed herein can be used before, during, and/or after alkylation to treat hydrocarbon components derived from alternative sources such as oil shale, oil sands, and tar sands. In particular, ion beam exposure (alone, or in combination with other methods) during alkylation can assist the addition reaction between olefins and isoparaffins. In some embodiments, ion beam exposure of the hydrocarbon components can reduce or even eliminate the need for sulfuric acid and/or hydrofluoric acid catalysts, reducing the cost and the hazardous nature of the alkylation process. The types of ions, the number of ion beam exposures, the exposure duration, and the ion beam current can be adjusted to preferentially encourage 1+1 addition reactions between the olefins and isoparaffins, and to discourage extended polymerization reactions from occurring.

(iii) Catalytic Reforming and Isomerization

In catalytic reforming processes, hydrocarbon molecular structures are rearranged to form higher-octane aromatics for the production of gasoline; a relatively minor amount of cracking occurs. Catalytic reforming primarily increases the octane of motor gasoline.

Typical feedstocks to catalytic reformers are heavy straight-run naphthas and heavy hydrocracker naphthas, which include paraffins, olefins, naphthenes, and aromatics. Paraffins and naphthenes undergo two types of reactions during conversion to higher octane components: cyclization, and isomerization. Typically, paraffins are isomerized and converted, to some extent, to naphthenes. Naphthenes are subsequently converted to aromatics. Olefins are saturated to form paraffins, which then react as above. Aromatics remain essentially unchanged.

During reforming, the major reactions that lead to the formation of aromatics are dehydrogenation of naphthenes and dehydrocyclization of paraffins. The methods disclosed herein can be used before, during, and/or after catalytic reformation to treat hydrocarbon components derived from alternative sources such as oil shale, oil sands, and tar sands. In particular, ion beam exposure (alone, or in combination with other methods) can be used to initiate and sustain dehydrogenation reactions of naphthenes and/or dehydrocyclization reactions of paraffins to form aromatic hydrocarbons. Single or multiple exposures of the hydrocarbon components to one or more different types of ions can be used to improve the yield of catalytic reforming processes. For example, in certain embodiments, dehydrogenation reactions and/or dehydrocyclization reactions proceed via an initial hydrogen abstraction. Exposure to negatively charged, basic ions can increase the rate at which such abstractions occur, promoting more efficient dehydrogenation reactions and/or dehydrocyclization reactions. In some embodiments, isomerization reactions can proceed effectively in acidic environments, and exposure to positively charged, acidic ions (e.g., protons) can increase the rate of isomerization reactions.

Catalysts used in catalytic reformation generally include platinum supported on an alumina base. Rhenium can be combined with platinum to form more stable catalysts that permit lower pressure operation of the reformation process. Without wishing to be bound by theory, it is believed that platinum serves as a catalytic site for hydrogenation and dehydrogenation reactions, and chlorinated alumina provides an acid site for isomerization, cyclization, and hydrocracking reactions. In general, catalyst activity is reduced by coke deposition and/or chloride loss from the alumina support. Restoration of catalyst activity can occur via high temperature oxidation of the deposited coke, followed by chlorination of the support.

In some embodiments, ion beam exposure can improve the efficiency of catalytic reformation processes by treating catalyst materials during and/or after reformation reactions occur. For example, catalyst particles can be exposed to ions that react with and oxidize deposited coke on catalyst surfaces, removing the coke and maintaining/returning the catalyst in/to an active state. The ions can also react directly with undeposited coke in the reformation reactor, preventing deposition on the catalyst particles. Moreover, the alumina support can be exposed to suitably chosen ions (e.g., chlorine ions) to re-chlorinate the surface of the support. By maintaining the catalyst in an active state for longer periods and/or scavenging reformation by-products, ion beam exposure can lead to improved throughput and/or reduced operating costs of catalytic reformation processes.

(iv) Catalytic Hydrocracking

Catalytic hydrocracking, a counterpart process to ordinary catalytic cracking, is generally applied to hydrocarbon components that are resistant to catalytic cracking A catalytic cracker typically receives as feedstock more easily cracked paraffinic atmospheric and vacuum gas oils as charge stocks. Hydrocrackers, in contrast, typically receive aromatic cycle oils and coker distillates as feedstock. The higher pressures and hydrogen atmosphere of hydrocrackers make these components relatively easy to crack.

In general, although many different simultaneous chemical reactions occur in a catalytic hydrocracker, the overall chemical mechanism is that of catalytic cracking with hydrogenation. In general, the hydrogenation reaction is exothermic and provides heat to the (typically) endothermic cracking reactions; excess heat is absorbed by cold hydrogen gas injected into the hydrocracker. Hydrocracking reactions are typically carried out at temperatures between 550 and 750° F., and at pressures of between 8275 and 15,200 kPa. Circulation of large quantities of hydrogen with the feedstock helps to reduce catalyst fouling and regeneration. Hydrocarbon feedstock is typically hydrotreated to remove sulfur, nitrogen compounds, and metals before entering the first hydrocracking stage; each of these materials can act as poisons to the hydrocracking catalyst.

Most hydrocracking catalysts include a crystalline mixture of silica-alumina with a small, relatively uniformly distributed amount of one or more rare earth metals (e.g., platinum, palladium, tungsten, and nickel) contained within the crystalline lattice. Without wishing to be bound by theory, it is believed that the silica-alumina portion of the catalyst provides cracking activity, and the rare earth metals promote hydrogenation. Reaction temperatures are generally raised as catalyst activity decreases during hydrocracking to maintain the reaction rate and product conversion rate. Regeneration of the catalyst is generally accomplished by burning off deposits which accumulate on the catalyst surface.

The methods disclosed herein can be used before, during, and/or after catalytic hydrocracking to treat hydrocarbon components derived from alternative sources such as oil shale, oil sands, and tar sands. In particular, ion beam exposure (alone, or in combination with other methods) can be used to initiate hydrogenation and/or cracking processes. Single or multiple exposures of the hydrocarbon components to one or more different types of ions can be used to improve the yield of hydrocracking by tailoring the specific exposure conditions to various process steps. For example, in some embodiments, the hydrocarbon components can be exposed to hydride ions to assist the hydrogenation process. Cracking processes can be promoted by exposing the components to reactive ions such as protons and/or carbon ions.

In certain embodiments, ion beam exposure can improve the efficiency of hydrocracking processes by treating catalyst materials during and/or after cracking occurs. For example, catalyst particles can be exposed to ions that react with and oxidize deposits on catalyst surfaces, removing the deposits and maintaining/returning the catalyst in/to an active state. The hydrocarbon components can also be exposed to ions that correspond to some or all of the metals used for hydrocracking, including platinum, palladium, tungsten, and nickel. This exposure to catalytic ions can increase the overall rate of the hydrocracking process.

(v) Other Processes

A variety of other processes that occur during the course of crude oil refining can also be improved by, or supplanted by, the methods disclosed herein. For example, the methods disclosed herein, including ion beam treatment of crude oil components, can be used before, during, and/or after refinery processes such as coking, thermal treatments (including thermal cracking), hydroprocessing, and polymerization to improve the efficiency and overall yields, and reduce the waste generated from such processes.

Particle Beam Exposure in Fluids

In some cases, the hydrocarbon-containing materials can be exposed to a particle beam in the presence of one or more additional fluids (e.g., gases and/or liquids). Exposure of a material to a particle beam in the presence of one or more additional fluids can increase the efficiency of the treatment.

In some embodiments, the material is exposed to a particle beam in the presence of a fluid such as air. Particles accelerated in any one or more of the types of accelerators disclosed herein (or another type of accelerator) are coupled out of the accelerator via an output port (e.g., a thin membrane such as a metal foil), pass through a volume of space occupied by the fluid, and are then incident on the material. In addition to directly treating the material, some of the particles generate additional chemical species by interacting with fluid particles (e.g., ions and/or radicals generated from various constituents of air, such as ozone and oxides of nitrogen). These generated chemical species can also interact with the material, and can act as initiators for a variety of different chemical bond-breaking reactions in the material. For example, any oxidant produced can oxidize the material, which can result in molecular weight reduction.

In certain embodiments, additional fluids can be selectively introduced into the path of a particle beam before the beam is incident on the material. As discussed above, reactions between the particles of the beam and the particles of the introduced fluids can generate additional chemical species, which react with the material and can assist in functionalizing the material, and/or otherwise selectively altering certain properties of the material. The one or more additional fluids can be directed into the path of the beam from a supply tube, for example. The direction and flow rate of the fluid(s) that is/are introduced can be selected according to a desired exposure rate and/or direction to control the efficiency of the overall treatment, including effects that result from both particle-based treatment and effects that are due to the interaction of dynamically generated species from the introduced fluid with the material. In addition to air, exemplary fluids that can be introduced into the ion beam include oxygen, nitrogen, one or more noble gases, one or more halogens, and hydrogen.

Process Water

In the processes disclosed herein, whenever water is used in any process, it may be grey water, e.g., municipal grey water, or black water. In some embodiments, the grey or black water is sterilized prior to use. Sterilization may be accomplished by any desired technique, for example by irradiation, steam, or chemical sterilization.

OTHER EMBODIMENTS

A number of embodiments of the invention have been described. Nevertheless, it will be understood that various modifications may be made without departing from the spirit and scope of the invention. Accordingly, other embodiments are within the scope of the following claims.

What is claimed is:

1. A method comprising:

exposing a material comprising a hydrocarbon selected from the group consisting of coal, bitumen, and mixtures thereof, the hydrocarbon being carried by an inorganic substrate comprising a material having a thermal conductivity of less than 5 W $m^{-1}$ $K^{-1}$, to a particle beam, x-rays or gamma rays, to deliver to the material at least 0.5 megarads of radiation.

2. The method of claim 1, wherein the inorganic substrate comprises exterior surfaces, and wherein the hydrocarbon is carried on at least some of the exterior surfaces.

3. The method of claim 1, wherein the inorganic substrate comprises interior surfaces, and wherein the hydrocarbon is carried on at least some of the interior surfaces.

4. The method of claim 1, wherein the inorganic substrate comprises at least one of an aluminosilicate material, a silica material, and an alumina material.

5. The method of claim 4, wherein the substrate further comprises a noble metal, such as platinum, iridium, or rhodium.

6. The method of claim 4, wherein the substrate comprises a zeolite material.

7. The method of claim 6, wherein the zeolite material has a base structure selected from the group consisting of ZSM-5, Zeolite Y, Zeolite Beta, mordenite, ferrierite, and mixtures of any two or more of these structures.

8. The method of claim 1 wherein the radiation is in the form of energetic particles.

9. The method of claim 1 wherein exposing the hydrocarbon to radiation reduces the molecular weight by at least about 25%.

10. The method of claim 9 wherein the hydrocarbon initially has a molecular weight of from about 300 to about 2000, and after irradiation the hydrocarbon has a molecular weight of from about 190 to about 1750.

11. The method of claim 1 further comprising delivering radiation to a site where the material is found.

12. A method of processing a hydrocarbon material, the method comprising:

exposing a hydrocarbon selected from the group consisting of coal, bitumen, and mixtures thereof that has been combined with a solid supporting material having a thermal conductivity of less than5 $W\ m^{-1}\ K^{-1}$ to a plurality of charged particles or photons to deliver a dose of radiation of at least 0.5 megarads.

13. The method of claim 12 further comprising processing the exposed combined hydrocarbon and solid supporting material to obtain at least one hydrocarbon product.

14. The method of claim 13, wherein the processing comprises oxidizing and/or reducing the combined hydrocarbon and solid supporting materials.

15. The method of claim 12, wherein the solid supporting material comprises at least one catalyst material.

16. The method of claim 15, wherein the at least one catalyst material comprises at least one material selected from the group consisting of platinum, rhodium, osmium, iron, and cobalt.

17. The method of claim 12, wherein the solid supporting material comprises a material selected from the group consisting of silicate materials, silicas, aluminosilicate materials, aluminas, oxide materials, and glass materials.

* * * * *